US005753081A

United States Patent [19]

Graf

[11] Patent Number: 5,753,081

[45] Date of Patent: May 19, 1998

[54] APPARATUS AND METHOD FOR CONTROLLING A PRESSURE OF A FIBER SUSPENSION IN A HEADBOX OR ASSOCIATED FLUID CONDUIT

[75] Inventor: Edwin X. Graf, Menasha, Wis.

[73] Assignee: Voith Sulzer Paper Technology North America, Inc., Appleton, Wis.

[21] Appl. No.: 748,177

[22] Filed: Nov. 12, 1996

[51] Int. Cl.[6] ..... D21F 1/06

[52] U.S. Cl. ..... 162/198; 162/29; 162/252; 162/263

[58] Field of Search ..... 162/198, 259, 162/252, 253, 263, DIG. 10, DIG. 11

[56] References Cited

PUBLICATIONS

Ericson, R. Barry, "Pulsation Measurement in Stock Approach Systems," Tappi Journal, vol. 59, No. 8, pp. 82–84, Aug. 1976.

Sine Pump® by Sundstrand Fluid Handling Corporation, product information (Internet site http://www.sfh.com/spdp/index.html) 1996.

*Primary Examiner*—Donald E. Czaja
*Assistant Examiner*—Steven B. Leavitt
*Attorney, Agent, or Firm*—Taylor & Associates, P.C.

[57] ABSTRACT

The invention is directed to a paper machine including a headbox having an inlet and an outlet. A fluid conduit is connected to the inlet of the headbox. A sensor is disposed in communication with an interior of the headbox. The sensor senses a pressure of the fiber suspension within the headbox and provides a signal corresponding thereto. A first pump is connected to the fluid conduit and supplies a fiber suspension to the headbox through the fluid conduit. A second pump is connected to the fluid conduit between the first pump and the headbox, and further is connected to the sensor. The second pump is a substantially pulseless pump, and transports the fiber suspension away from the fluid conduit, dependent upon the sensed signal.

16 Claims, 2 Drawing Sheets

APPARATUS AND METHOD FOR CONTROLLING A PRESSURE OF A FIBER SUSPENSION IN A HEADBOX OR ASSOCIATED FLUID CONDUIT

BACKGROUND OF THE INVENTION

1. Field of the Invention

The present invention relates to paper machines, and, more particularly, to paper machines including an active pressure attenuator associated with a fluid conduit connected to an inlet of a headbox.

2. Description of the Related Art

A paper machine typically includes a headbox at the wet end thereof having an inlet and an outlet. A fiber suspension is received at the inlet of the headbox, and is discharged from the outlet of the headbox onto a wire, such as a wire of a fordrinier section. A fan pump is typically connected to the inlet of the headbox via a fluid conduit, and supplies the fiber suspension to the headbox in known manner.

It is desirable to supply the fiber suspension to the headbox at a substantially constant operating pressure such that the discharge from the outlet of the headbox likewise remains substantially constant. A problem with utilizing a fan pump to supply the fiber suspension to the headbox is that both low frequency and high frequency pressure fluctuations appear within the fiber suspension in the headbox as a result of the operating characteristics of the fan pump. The high frequency pressure fluctuations are addressed by a passive pulsation attenuator. However, the low frequency pressure fluctuations, which may be in the form of substantially sinusoidal pressure fluctuations, may affect the characteristics of the fiber suspension which is discharged from the outlet of the headbox, and thus in turn affect the quality of the paper which is produced.

One known method of reducing the low frequency pressure fluctuations which appear in the headbox is to use a valve which is connected to the fluid conduit between the fan pump and the headbox. The valve is opened during periods of increased amplitude of a pressure profile curve associated with the fiber suspension in the headbox. Bleeding off a portion of the fiber suspension within the fluid conduit using such a valve helps to flatten out the pressure profile curve associated with the fiber suspension, and thus actively attenuates the pressure of the fiber suspension within the fluid conduit and headbox.

It has been found that a valve as described above has an effective life span of only a few weeks when used to bleed off high pressure and low frequency pressure fluctuations of the fiber suspension in the fluid conduit. It is believed that since such a valve is typically intended to be set or adjusted and left for a period of time thereafter, the continuous adjusting of the valve when used as an active pressure attenuator results in a relatively short life span thereof.

Another known method of attenuating the pressure fluctuations in the headbox is to control the operating speed of the fan pump which supplies the fiber suspension to the headbox. However, such a fan pump is typically in the form of a pump driven by a large electric motor, such as a motor of up to approximately 2400 HP. Such a motor is sometimes too large and may have too much inertia to effectively control the operational speed thereof and in turn control pressure fluctuations of the fiber suspension within the headbox which may occur over fractions of a second.

What is needed in the art is an active pressure attenuator which effectively attenuates pressure fluctuations of the fiber suspension in the headbox, and which has a relatively long life span, thus reducing repair costs.

SUMMARY OF THE INVENTION

The present invention provides a paper machine which uses a positive displacement, essentially pulseless pump, which is connected to a fluid conduit attached to a headbox. The positive displacement pump transports a variable volume of a fiber suspension away from the fluid conduit, with the varying volume of transported fiber suspension being controlled substantially in phase with the pressure of the fiber suspension in the headbox.

The invention comprises, in one form thereof, a paper machine including a headbox having an inlet and an outlet. A fluid conduit is connected to the inlet of the headbox. A sensor is disposed in communication with an interior of the headbox. The sensor senses a pressure of the fiber suspension within the headbox and provides a signal corresponding thereto. A first pump is connected to the fluid conduit and supplies a fiber suspension to the headbox through the fluid conduit. A second pump is connected to the fluid conduit between the first pump and the headbox, and further is connected to the sensor. The second pump is a substantially pulseless pump, and transports the fiber suspension away from the fluid conduit, dependent upon the sensed signal.

An advantage of the present invention is that low frequency pressure fluctuations within the fluid conduit are substantially reduced.

Another advantage is that an active pressure attenuator is provided for reducing low frequency pressure fluctuations in the fluid conduit, with replacement costs which are substantially decreased in frequency and expense.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
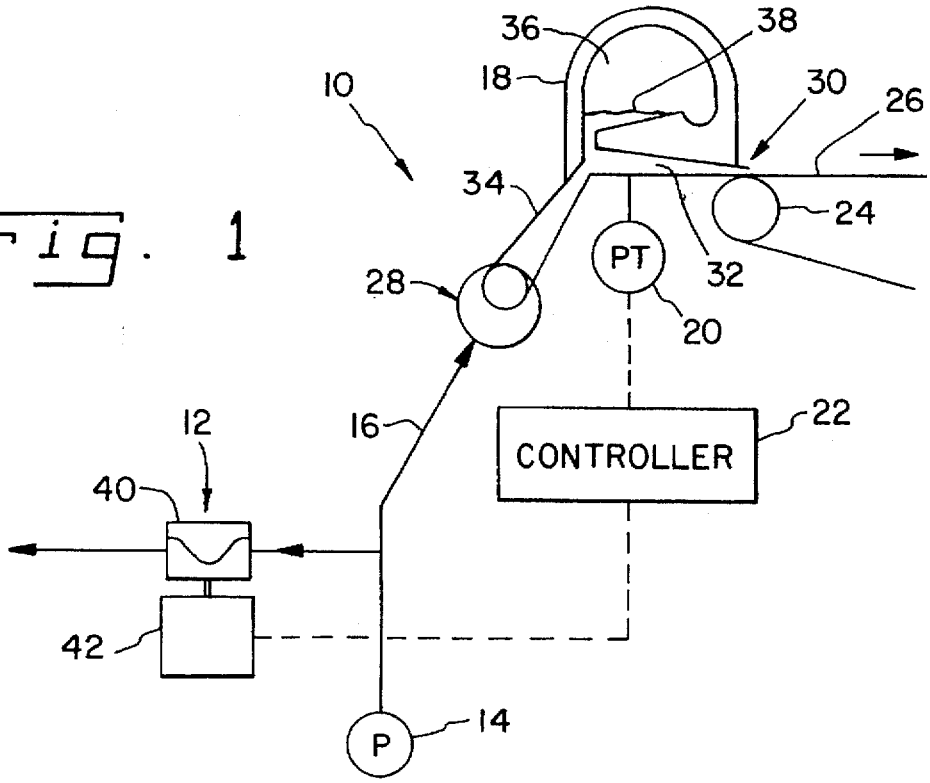
FIG. 1 is a partial, schematic view of an embodiment of a paper machine of the present invention.

Referring now to the drawings, and more particularly to FIG. 1, there is shown a portion of a paper machine 10 including an active pressure attenuator 12 of the present invention. Paper machine 10 also includes a fan pump 14, fluid conduit 16, headbox 18, sensor or pressure transmitter (PT) 20, controller 22, breast roll 24 and wire 26.

Headbox 18, in the embodiment shown, is in the form of a hydraulic headbox including an inlet 28, an outlet 30 and a nozzle section 32. Inlet 28 is connected to fluid conduit 16, and includes a tapered header 34. The fiber suspension which is supplied via fluid conduit 16 flows through tapered header 34 and into an interior 36 of headbox 18. The fiber suspension may be disposed at a level 38 within interior 36 of headbox 18, as is known. Headbox 18 is also configured to define tapered nozzle section 32 which terminates at outlet 30. The fiber suspension increases in velocity as it flows through nozzle section 32 and is discharged from outlet 30 onto wire 26.

Figure 2:
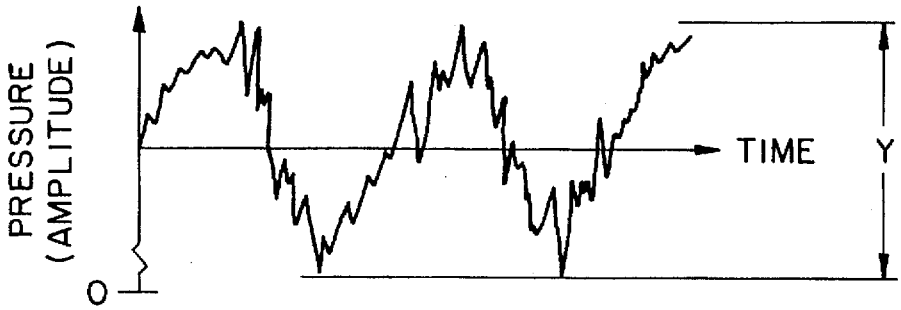
FIG. 2 is a graphical illustration of a pressure profile curve of a fiber suspension within a headbox, showing both low frequency and high frequency pressure fluctuations when the fiber suspension is transported into the headbox using a conventional fan pump.

A first pump in the form of a fan pump 14 is connected to headbox 18 via fluid conduit 16 and supplies the fiber suspension to headbox 18. The fiber suspension which is pumped by fan pump 14 through fluid conduit 16 exhibits both low frequency pressure fluctuations as well as high frequency pressure fluctuations as a result of operational characteristics of fan pump 14. More particularly, the pressure profile curve which is exhibited by the fiber suspension within fluid conduit 16 and headbox 18 has a substantially sinusoidal shape with both low frequency and high frequency pressure fluctuations (FIG. 2). The low frequency pressure fluctuations define the overall substantially sinusoidal shape of the profile curve and have an overall amplitude represented by the dimension Y in FIG. 2. The high frequency pressure fluctuations are represented by the smaller pressure fluctuations or hash within the sinusoidal shape of the pressure profile curve in FIG. 2.

Active pressure attenuator 12 is in the form of a second pump which is a positive displacement, substantially pulseless pump 40 driven by an electric motor 42. In the embodiment shown, second pump 40 is in the form of a Sine Pump (TM) manufactured by the Milton Roy Company, Arvada, Colo. Sine Pump 40 is connected to fluid conduit 16 between fan pump 14 and headbox 18. Sine Pump 40 is configured to transport a selectively variable volume of the fiber suspension away from fluid conduit 16, as will be described in greater detail hereinafter.

Figure 4:
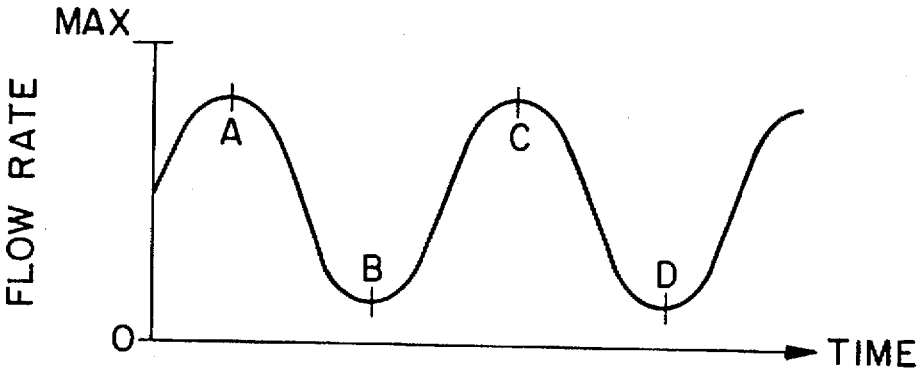
FIG. 4 is a graphical illustration of a controlled flow rate of a positive displacement Sine Pump (TM) which is connected to the fluid conduit between the fan pump and headbox, with the flow rate being substantially in phase with the pressure profile curve shown in FIG. 3.

Sine Pump 40 is configured as a pulseless pump such that additional pressure fluctuations are not induced into the flow of fiber suspension within fluid conduit 16 during operation of Sine Pump 40 (cf. a piston pump or a conventional centrifugal pump). Sine Pump 40 is controlled to a volumetric flow rate which is substantially sinusoidal-shaped (FIG. 4). Sine Pump 40 provides a positive displacement (cf. a continuous flow pump such as a centrifugal pump).

Sensor 20 is disposed in communication with an interior of nozzle section 32 of headbox 18. Sensor 20 senses a pressure of the fiber suspension within nozzle section 32 and provides a signal corresponding thereto. Although not preferred, sensor 20 may also be disposed in communication with an interior of tapered header 34 or fluid conduit 16.

Controller 22 electrically interconnects sensor 20 with motor 42 of active pressure attenuator 12. Controller 22 receives a signal from sensor 20 and controls an operating speed of motor 42, dependent upon the value of the sensed signal corresponding to the pressure of the fiber suspension within nozzle section 32. Controller 22 may be in the form of any conventional controller which is capable of controlling the operating speed of motor 42. For example, controller 22 may be in the form of an analog or digital controller, and may control the operating speed of motor 42 using electrical hardware, software and/or firmware. An example of a controller which may be used with the present invention is a current source inverter control for an A.C. variable speed motor with rotational speed feedback, manufactured by Robicon, Pittsburgh, Pa.

Figure 3:
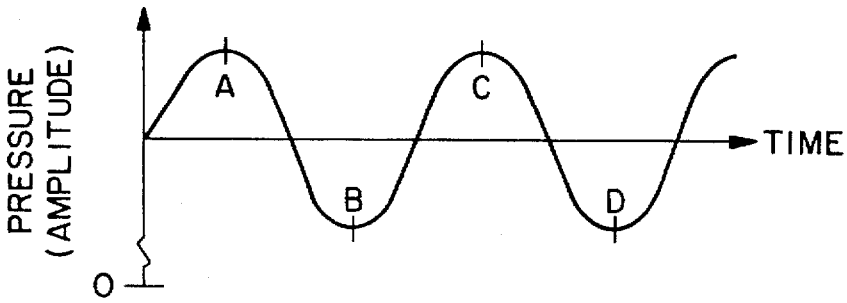
FIG. 3 is a graphical illustration of a pressure profile curve similar to the graph shown in FIG. 2, but after the high frequency pressure fluctuations are filtered.

Controller 22 also includes appropriate electrical filtering circuitry such as a low pass filter or the like which is used to filter out the high frequency pressure fluctuations in the signal provided by sensor 20. FIG. 3 illustrates an example of a substantially sinusoidal-shaped pressure profile curve which exists after the high frequency pressure fluctuations are filtered out of the signal provided by sensor 20 using a low pass filter or filters within controller 22. The pressure profile curve shown in FIG. 3 corresponding to the low frequency pressure fluctuations within the signal provided by sensor 20 includes a plurality of phases, as is apparent. Attenuating these low frequency pressure fluctuations, while at the same time ignoring the less troublesome high frequency pressure fluctuations, improves the formation of the fiber suspension which is discharged from outlet 30 of headbox 18.

In operation, the fiber suspension is pumped from fan pump 14 and through fluid conduit 16 to interior 36 of headbox 18. The pressure of the fiber suspension within nozzle section 32 is sensed using sensor 20 and a corresponding signal is output to controller 22. Controller 22 controls the operating speed of motor 42, which in turn affects the variable volumetric flow rate from Sine Pump 40. The operating speed of motor 42 and the volumetric flow rate of Sine Pump 40 are controlled such that the flow rate from Sine Pump 40 is substantially in phase with the sensed low frequency pressure fluctuations within nozzle section 32. Referring more specifically to FIGS. 3 and 4, conjunctively, it may be observed that at any particular point in time, such as points A–D, the flow rate of Sine Pump 40 is substantially in phase with the sensed pressure within nozzle section 32.

Figure 5:
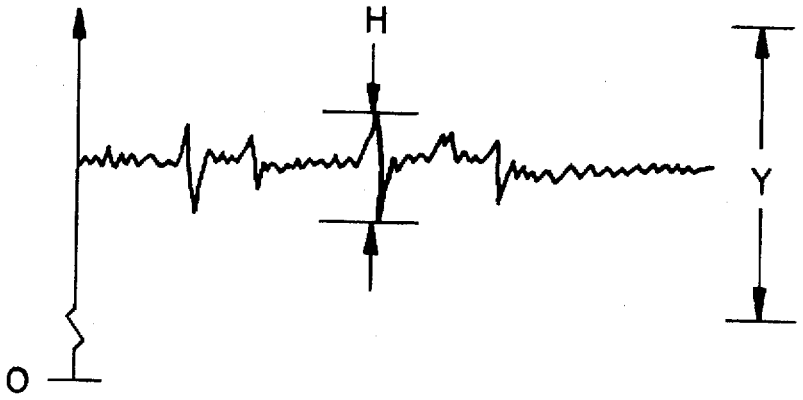
FIG. 5 is a graphical illustration of a pressure profile curve of the fiber suspension within the headbox after the low frequency pressure fluctuations shown in FIG. 3 have been attenuated by controlling the operating speed of the sine pump as shown in FIG. 4.

FIG. 5 illustrates a pressure of the fiber suspension within nozzle section 32 after the low frequency pressure fluctuations are attenuated using active pressure attenuator 12 as described above. The absolute amplitude Y of the low frequency pressure fluctuations shown in FIG. 2 are absent from the pressure of the fiber suspension within nozzle section 32 after the pressure is actively attenuated as described above. The only pressure fluctuations within the fiber suspension are the high frequency pressure fluctuations with an amplitude H. These high frequency pressure fluctuations have not been found to substantially affect the formation of the fiber suspension which is output from outlet 30 of headbox 18.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fiber suspension delivery apparatus, comprising:

a headbox having an inlet and an outlet;

a fluid conduit connected to said inlet of said headbox;

a first pump connected to said fluid conduit for supplying a fiber suspension to said headbox through said fluid conduit;

a sensor disposed in communication with an interior of one of said headbox and said fluid conduit for sensing a pressure of the fiber suspension and providing a signal corresponding thereto; and a second pump connected to said fluid conduit between said first pump and said headbox, and further being connected to said sensor, said second pump comprising a substantially pulseless pump, said second pump being configured to transport a variable volume of the fiber suspension away from said fluid conduit, dependent upon said sensed pressure.

2. The fiber suspension delivery apparatus of claim 1, wherein said second pump comprises a positive displacement pump.

3. The fiber suspension delivery apparatus of claim 2, wherein said positive displacement pump has a volumetric flow rate with a sinusoidal profile.

4. The fiber suspension delivery apparatus of claim 1, further comprising a controller disposed between and interconnecting each of said sensor and said second pump, said second pump having a variable operating speed, said controller receiving said sensor signal and controlling said operating speed of said second pump, dependent upon said sensed pressure.

5. The fiber suspension delivery apparatus of claim 1, wherein said sensor is in communication with said interior of said headbox and provides a signal corresponding to a pressure of the fiber suspension within said headbox.

6. The fiber suspension delivery apparatus of claim 5, wherein said sensor is in communication with a nozzle section in said interior of said headbox.

7. The fiber suspension delivery apparatus of claim 1, wherein said first pump comprises a fan pump.

8. A method of controlling a pressure of a fiber suspension in a headbox, said method comprising the steps of:

providing a headbox having an inlet and an outlet;

providing a fluid conduit connected to said headbox inlet;

providing a first pump connected to said fluid conduit;

providing a second pump connected to said fluid conduit between said first pump and said headbox, said second pump comprising a substantially pulseless pump;

transporting a fiber suspension to said headbox through said fluid conduit using said first pump;

sensing a pressure of the fiber suspension in one of the headbox and the fluid conduit using a sensor; and pumping a variable volume of the fiber suspension away from the fluid conduit with said second pump, dependent upon said sensed pressure.

9. The method of claim 8, wherein said second pump comprises a positive displacement pump.

10. The method of claim 9, wherein said positive displacement pump has a volumetric flow rate with a sinusoidal profile.

11. The method of claim 8, wherein said sensing step comprises sensing a pressure of the fiber suspension in said headbox.

12. The method of claim 11, wherein said sensing step comprises sensing a pressure of the fiber suspension in a nozzle section of said headbox.

13. The method of claim 8, comprising the further step of providing a controller, said controller electrically interconnecting said sensor with said second pump, said controller controlling said operating speed of said second pump, dependent upon said sensed signal.

14. The method of claim 13, wherein said sensed pressure of the fiber suspension varies with time.

15. The method of claim 14, wherein said sensed pressure of the fiber suspension has a substantially sinusoidal pressure profile curve with a plurality of phases, and wherein said controlling step comprises controlling said operating speed of said second pump to be substantially out of phase with said sinusoidal pressure profile curve.

16. The method of claim 15, wherein said pressure profile curve has a plurality of maximum amplitudes, and wherein said second pump is operated faster during periods of time corresponding to said maximum amplitudes.

* * * * *